US011708950B1

(12) United States Patent
Lai et al.

(10) Patent No.: US 11,708,950 B1
(45) Date of Patent: Jul. 25, 2023

(54) NIGHT DOWNLIGHT

(71) Applicant: Xiamen Topstar Lighting Co., Ltd., Xiamen (CN)

(72) Inventors: Jiajie Lai, Xiamen (CN); Xibin Lin, Xiamen (CN); Yongjie Wu, Xiamen (CN)

(73) Assignee: Xiamen Topstar Lighting Co., Ltd., Xiamen (CN)

( * ) Notice: Subject to any disclaimer, the term of this patent is extended or adjusted under 35 U.S.C. 154(b) by 0 days.

(21) Appl. No.: 18/151,339

(22) Filed: Jan. 6, 2023

(30) Foreign Application Priority Data

Dec. 1, 2022 (CN) ..... 202223233545.6

(51) Int. Cl.
*F21S 8/02* (2006.01)
*F21V 17/04* (2006.01)
*F21V 17/16* (2006.01)

(52) U.S. Cl.
CPC ..... *F21S 8/026* (2013.01); *F21V 17/04* (2013.01); *F21V 17/164* (2013.01)

(58) Field of Classification Search
CPC ..... F21S 8/026; F21V 17/04; F21V 17/164
See application file for complete search history.

(56) References Cited

U.S. PATENT DOCUMENTS 11,280,957 B1 * 3/2022 Wang ..... G02B 6/0073
2020/0124271 A1 * 4/2020 Spencer ..... F21V 23/003

FOREIGN PATENT DOCUMENTS

CN 214222891 U * 9/2021
DE 102013021357 A1 * 7/2015 ..... F21S 8/02

OTHER PUBLICATIONS

Machine translation of DE-102013021357-A1 (Year: 2015).*

* cited by examiner

*Primary Examiner* — Anne M Hines
*Assistant Examiner* — Jose M Diaz
(74) *Attorney, Agent, or Firm* — Westbridge IP LLC

(57) ABSTRACT

Disclosed is a night downlight, including a plastic housing, a light source plate, a reflective cup, and a light guide sleeve. The plastic housing is provided with an opening, and the light source plate is arranged on an inner side of the plastic housing opposite to the opening. The light source plate is provided with a first light source and a second light source. One end of the reflective cup abuts against the light source plate. The light guide sleeve is arranged between the other end of the reflective cup and the plastic housing. The light guide sleeve is in snap-fit with the reflective cup. The snap-fit design of the light guide sleeve and the reflective cup allows replacement of the small component rather than replacement of the whole face ring when the snap-fit structure fails, thereby effectively reducing waste in repair and replacement.

10 Claims, 5 Drawing Sheets

NIGHT DOWNLIGHT

CROSS-REFERENCE TO RELATED APPLICATIONS

The present application claims the benefit of Chinese Patent Application No. 202223233545.6 filed on Dec. 1, 2022, the contents of which are incorporated herein by reference in their entirety.

TECHNICAL FIELD

The present application relates to the technical field of light fixtures, and in particular, to a night downlight.

BACKGROUND

In the prior art, a downlight with a night light function generally has a structure in which a light source plate is provided with a first light source in the middle of the light source plate and a second light source surrounding the first light source. The two light sources are separated by a reflective cup, where the first light source emits light via the reflective cup as a main light source, and the second light source emits light via a light guide ring at the periphery of the reflective cup as a night light source. Chinese patent application No. CN202021265094.2 discloses a downlight, including a light guide ring (equivalent to a light guide sleeve), a face ring and a reflective cup. The light guide ring abuts against the reflective cup. The light guide ring is provided with a first snap-fit groove, and the face ring is provided with a first snap-fit ridge fitting the first snap-fit groove. The face ring and the light guide ring can be quickly assembled by snap-fit joints. However, as the face ring is a large component accommodating the reflective cup, the light guide ring, the light source plate, and other structures, once the snap-fit structure of the face ring fails, the whole face ring needs to be replaced, and the other normal structures of the face ring are scrapped, causing a waste in repair and replacement. In addition, since the light guide ring is arranged on the inner side of the face ring, the snap-fit structure on the inner side of the face ring requires a relatively complicated mould in injection moulding.

SUMMARY

A technical problem to be solved by the present application is to provide a night downlight which requires less components to be replaced when a fixing structure of a light guide sleeve fails, thereby avoiding waste and facilitating manufacturing.

In order to solve the above technical problem, the present application adopts the following technical solution: a night downlight, including a plastic housing, a light source plate, a reflective cup and a light guide sleeve, where the plastic housing is provided with an opening, the light source plate is arranged on an inner side of the plastic housing opposite to the opening, the light source plate is provided with a first light source and a second light source, the first light source is arranged in the middle of the light source plate, and the second light source is arranged around the first light source; one end of the reflective cup abuts against the light source plate and separates the first light source and the second light source, the light guide sleeve is arranged between the other end of the reflective cup and the plastic housing, and the light guide sleeve is in snap-fit with the reflective cup.

Furthermore, a snap-fit holder protrudes from an outer side of the reflective cup, and a snap-fit groove is formed in the snap-fit holder; the light guide sleeve is circumferentially provided with a projected snap-fit rib, and the snap-fit rib is snapped in the snap-fit groove.

Furthermore, a lower end of the light guide sleeve extends to an edge of the opening of the plastic housing; the light guide sleeve abuts against an inner wall of the plastic housing, and the inner wall of the plastic housing is provided with anti-skid patterns corresponding to the light guide sleeve.

Furthermore, an anti-glare ring is arranged on an inner wall of a part, away from the reflective cup, of the light guide sleeve.

Furthermore, a positioning column protrudes from the inner side of the plastic housing, the light source plate is provided with a first positioning hole corresponding to the positioning column, the end, abutting against the light source plate, of the reflective cup is provided with a positioning lug, and the positioning lug is provided with a second positioning hole corresponding to the positioning column.

Furthermore, the light source plate is provided with a drive unit arranged between the reflective cup and the inner wall of the plastic housing.

Furthermore, a slide actuator is arranged on a side face of the plastic housing, and the drive unit includes a selector switch connected to the slide actuator.

Furthermore, an abutting base is arranged on the inner wall of the plastic housing, an elastic abutting block is arranged on the abutting base, the elastic abutting block has an inclined surface at a side opposite to a side face of the light source plate, and the length of an end of the elastic abutting block proximal to the opening of the plastic housing is less than the length of an end of the elastic abutting distal from the opening of the plastic housing; the end of the abutting block distal from the opening of plastic housing abuts the surface of the light source plate.

Furthermore, the night downlight includes a diffuser, and the end of the reflective cup away from the light source plate is in snap-fit with the diffuser.

Furthermore, a locking column provided protrudes from the inner side of the plastic housing, a first locking hole is formed in the locking column; and an avoiding hole is formed in the light source plate corresponding to the locking column; a mounting base protrudes from the inner wall of the reflective cup corresponding to the locking column, the mounting base abuts against the locking column, and a second locking hole opposite to the first lock hole is formed in the mounting base.

The present application has the following beneficial effects. Compared with the snap-fit design on the large component, i.e., the face ring, the snap-fit design of the light guide sleeve and the reflective cup allows replacement of the small component, i.e., the reflective cup, rather than replacement of the whole face ring when the snap-fit structure fails, thereby effectively reducing waste in repair and replacement. Besides, there is no snap-fit structure on the inner side of the plastic housing, so that the mould is simplified, and the cost is reduced. In addition, the first light source emits light via the reflective cup as a main light source, and the second light source emits light via the light guide sleeve as a night light source, so as to enable the downlight to have multiple functions.

DETAILED DESCRIPTIONS OF THE EMBODIMENTS

Figure 1:
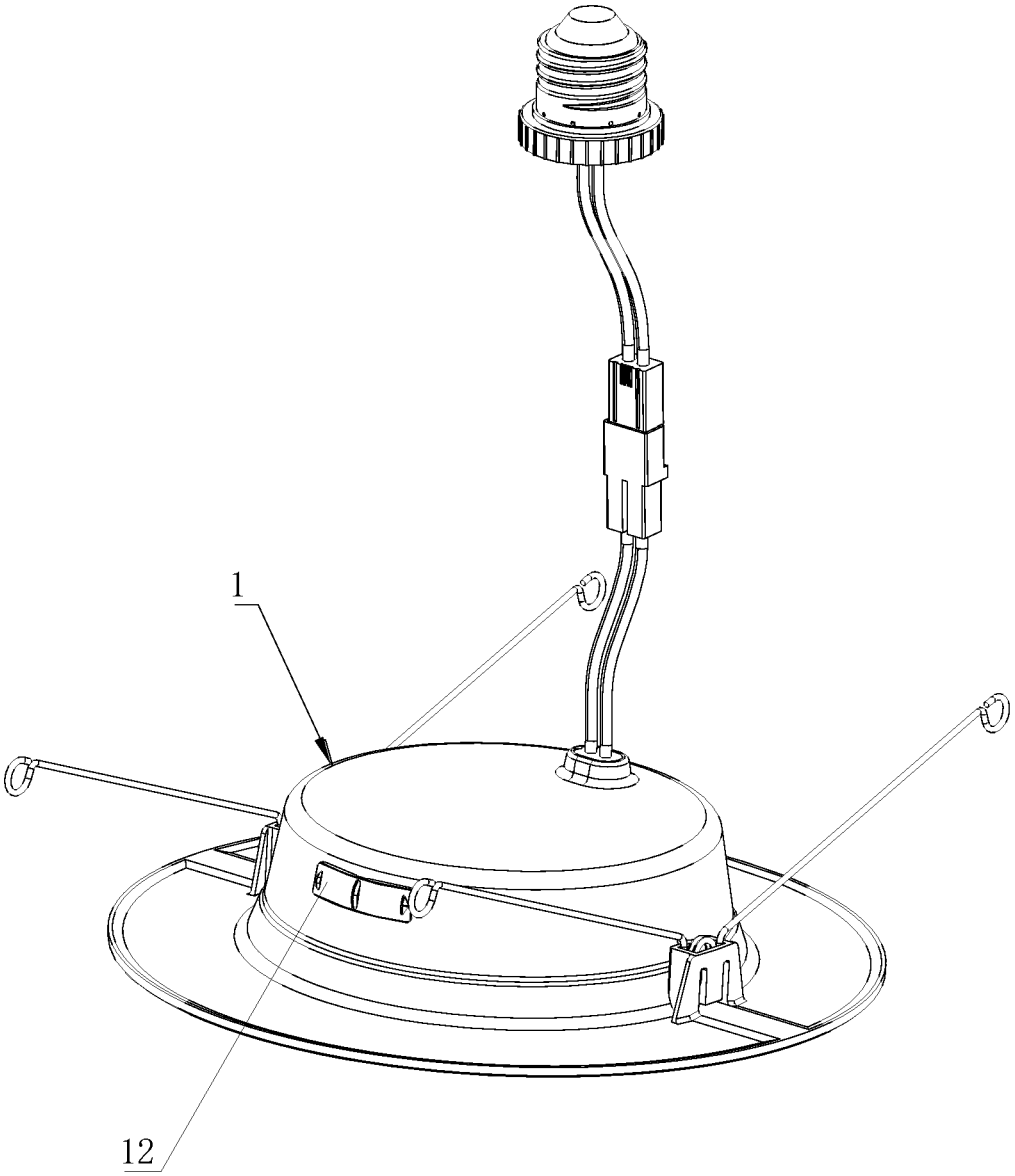
FIG. 1 is a schematic structural diagram of a night downlight according to an embodiment of the present application.

In order to explain the technical contents, objects, and effects of the present application in detail, the embodiments will be described below with reference to the accompanying drawings.

With reference to FIGS. 1 to 5, a night downlight includes a plastic housing 1, a light source plate 2, a reflective cup 3 and a light guide sleeve 4. The plastic housing 1 is provided with an opening, the light source plate 2 is arranged on an inner side of the plastic housing 1 opposite to the opening, the light source plate 2 is provided with a first light source 21 and a second light source 22, the first light source 21 is arranged in the middle of the light source plate 2, and the second light source 22 is arranged around the first light source 21.

One end of the reflective cup 3 abuts against the light source plate 2 and separates the first light source 21 and the second light source 22, the light guide sleeve 4 is arranged between the other end of the reflective cup 3 and the plastic housing 1, and the light guide sleeve 4 is in snap-fit with the reflective cup 3.

It can be seen from the above description that the present application has the following beneficial effects. Compared with the snap-fit design on the large component, i.e., the face ring, the snap-fit design of the light guide sleeve 4 and the reflective cup 3 allows replacement of the small component, i.e., the reflective cup 3, rather than replacement of the whole ring when the snap-fit fails, thereby effectively reducing waste in repair and replacement. Besides, there is no snap-fit structure on the inner side of plastic housing, so that the mould is simplified, and the cost is reduced. In addition, the first light source 21 emits light via the reflective cup 3 as a main light source, and the second light source 22 emits light via the light guide sleeve 4 as a night light source, so as to enable the downlight to have multiple functions.

Furthermore, a snap-fit holder 31 protrudes from an outer side of the reflective cup 3, and a snap-fit groove is formed in the snap-fit holder 31; the light guide sleeve 4 is circumferentially provided with a projected snap-fit rib 41, and the snap-fit rib 41 is snapped in the snap-ft groove.

It can be seen from the above description that the snap-fit holder 31 on the outer side of the reflective cup 3 cooperates with the snap-fit rib 41 of the light guide sleeve 4 to provide quick fixation of the light guide sleeve 4.

Furthermore, a lower end of the light guide sleeve 4 extends to an edge of the opening of the plastic housing 1; the light guide sleeve 4 abuts against an inner wall of the plastic housing 1, and the inner wall of the plastic housing 1 is provided with anti-skid patterns corresponding to the light guide sleeve 4.

It can be seen from the above description that the extension of the lower end of the light guide sleeve 4 ensures that the light emitted by the second light source 22 can be effectively transmitted to the outside of the plastic housing 1, without being blocked by other structures of the plastic housing 1; the contact area with the plastic housing 1 is also increased to prevent the light guide sleeve 4 from falling out due to shaking and other conditions; in addition, the anti-skid patterns provided on the inner wall of the plastic housing 1 corresponding to the light guide sleeve 4 further prevent the light guide sleeve 4 from falling out.

Furthermore, an anti-glare aperture 42 is arranged on the inner wall of a part, away from the reflective cup 3, of the light guide sleeve 4.

It can be seen from the above description that the light emitted by the first light source 21 is softened by the anti-glare ring 42 provided on the light guide sleeve 4, so as to achieve the anti-glare effect.

Furthermore, a positioning column 11 protrudes from the inner side of the plastic housing 1, the light source plate 2 is provided with a first positioning hole 23 corresponding to the positioning column 11, the end, abutting against the light source plate 2, of the reflective cup 3 is provided with a positioning lug 32, and the positioning lug 32 is provided with a second positioning hole corresponding to the positioning column 11.

It can be seen from the above description that quick positioning of the plastic housing 1, the light source plate 2 and the reflective cup 3 can be achieved through the cooperation of the positioning column 11 on the inner side of the plastic housing 1, the first positioning hole 23 on the light source plate 2 and the positioning lug 32 on the reflective cup 3.

Furthermore, the light source plate 2 is provided with a drive unit 24 arranged between the reflective cup 3 and the inner wall of the plastic housing 1.

It can be seen from the above description that the space between the reflective cup 3 and the plastic housing 1 is appropriately utilized for the arrangement of the drive unit 24 of the light source plate 2.

Furthermore, a slide actuator 12 is arranged on a side face of the plastic housing 1, and the drive unit 24 includes a selector switch connected to the slide actuator 12.

It can be seen from the above description that through the cooperation between the slide actuator 12 provided on the side face of the plastic housing 1 and the selector switch on the drive unit 24, an operator can simply slide the slide actuator 12 to switch between the functions , including three functions of only the first light source 21 emitting light, only the second light source 22 emitting light, and both the first light source 21 and the second light source 22 emitting light.

Furthermore, an abutting base 13 is arranged on the inner wall of the plastic housing 1, an elastic abutting block 14 is arranged on the abutting base 13, the elastic abutting block 14 has an inclined surface at a side opposite to a side face of the light source plate 2, and the length of an end of the elastic abutting block 14 proximal to the opening of the plastic housing 1 is less than the length of an end of the elastic abutting block 14 distal from the opening of the plastic housing 1; the end of the elastic abutting block 14 distal from the opening of the plastic housing 1 abuts against the surface of the light source plate 2.

It can be seen from the above description that through the structural design of the abutting base 13 and the elastic abutting block 14 on the inner wall of the plastic housing 1, when the light source plate 2 is pressed into the inner side of the plastic housing 1 from the opening of the plastic housing 1, the edge of the light source plate 2 may abut against the inclined surface of the elastic abutting block 14, and move towards the inner side of the plastic housing 1 under the guidance of the inclined surface, and the elastic abutting block 14 may be elastically deformed so as to press against the inner wall of the plastic housing 1. Then, when the light source plate 2 is completely in the plastic housing 1, the lower end of the elastic abutting block 14 is flush with the surface of the light source plate 2, and the light source plate 2 no longer abuts against the inclined surface, causing the elastic abutting block 14 to rebound so that the lower end of the elastic abutting block 14 abuts against the surface of the light source plate 2, thereby fixing and preventing the light source plate 2 from coming out of the opening of the plastic housing 1.

Furthermore, the night downlight includes a diffuser 5, and the end of the reflective cup 3 away from the light source plate 2 is in snap-fit with the diffuser 5.

It can be seen from the above description that the light output effect of the first light source 21 on the light source plate 2 is adjusted by the diffuser 5, and the illumination range is expanded.

Furthermore, a locking column 15 protrudes from the inner side of the plastic housing 1, a first locking hole 16 is formed in the locking column 15, and an avoiding hole 25 is formed in the light source plate 2 corresponding to the locking column 15; a mounting base 33 protrudes from the inner wall of the reflective cup 3 corresponding to the locking column 15, the mounting base 33 abuts against the locking column 15, and a second locking hole 34 opposite to the first locking hole 16 is formed in the mounting base 33.

It can be seen from the above description that the positioning of the reflective cup 3, when mounted, on the inner side of the plastic housing 1 is achieved by the abutment of the mounting base 33 of the reflective cup 3 and the locking column 15, and then a bolt passes through the second locking hole 34 of the mounting base 33 and the first locking hole 16 of the locking column 15 to fix the reflective cup 3 in the plastic housing 1.

With reference to FIGS. 1 to 5, an embodiment of the present application is as flows.

An application scenario of the present application: the cooperation between the light guide ring and a corresponding fixing structure of the light fails, and the light guide ring needs to be replaced. A traditional downlight adopts a snap-fit between the face ring and the light guide ring. As the face ring is a large component accommodating the reflective cup 3, the light guide ring, the light source plate 2, and other structures, once the snap-fit structure of the face ring fails, the whole face ring needs to be replaced, and the other normal structures of the face ring are scrapped, causing a waste in repair and replacement.

As shown in FIGS. 1 to 5, a night downlight of the present embodiment includes a plastic housing 1, a light source plate 2, a reflective cup 3, a light guide sleeve 4 and a diffuser 5.

Figure 2:
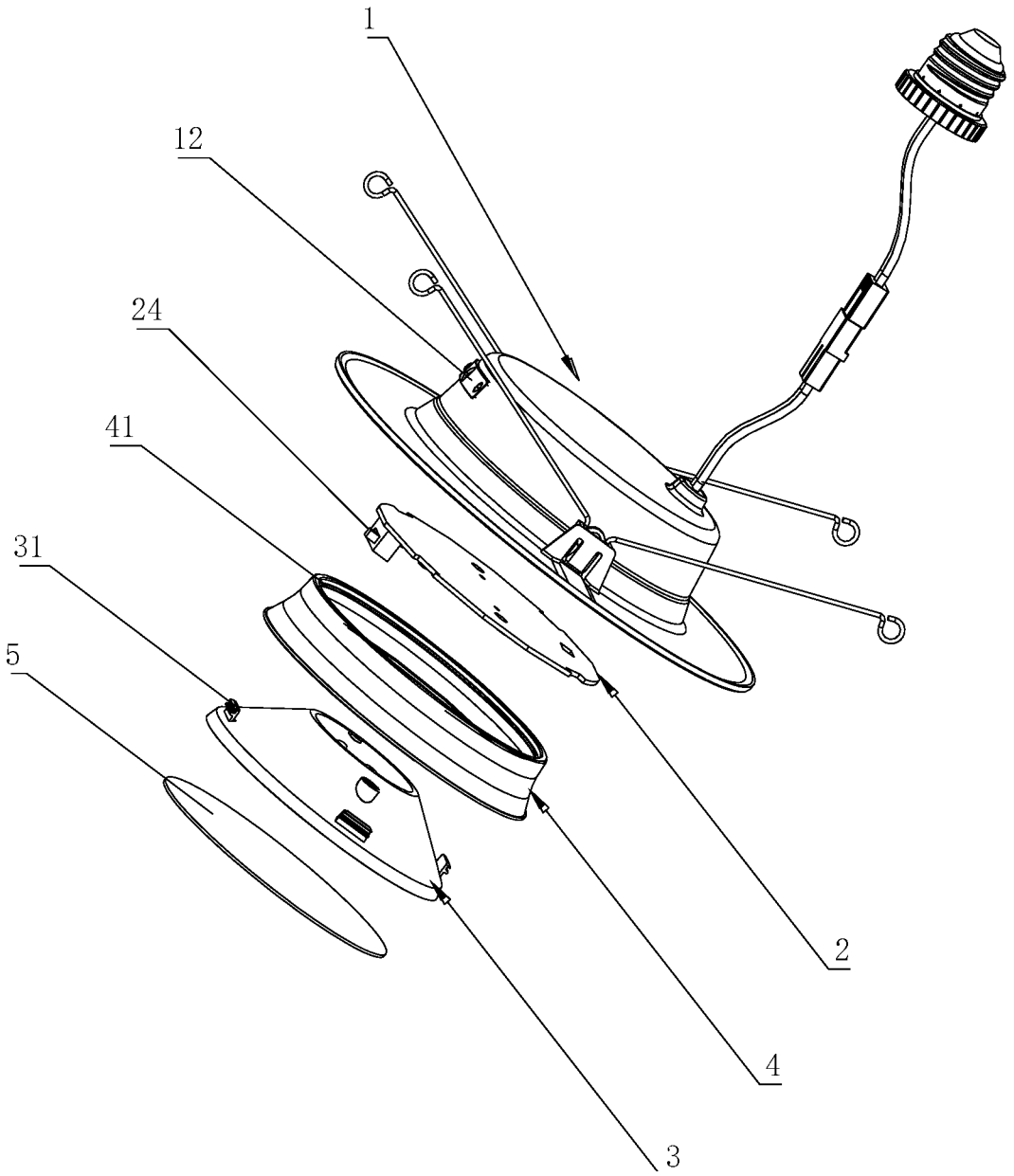
FIG. 2 is an exploded view of a night downlight according to an embodiment of the present application.
Figure 3:
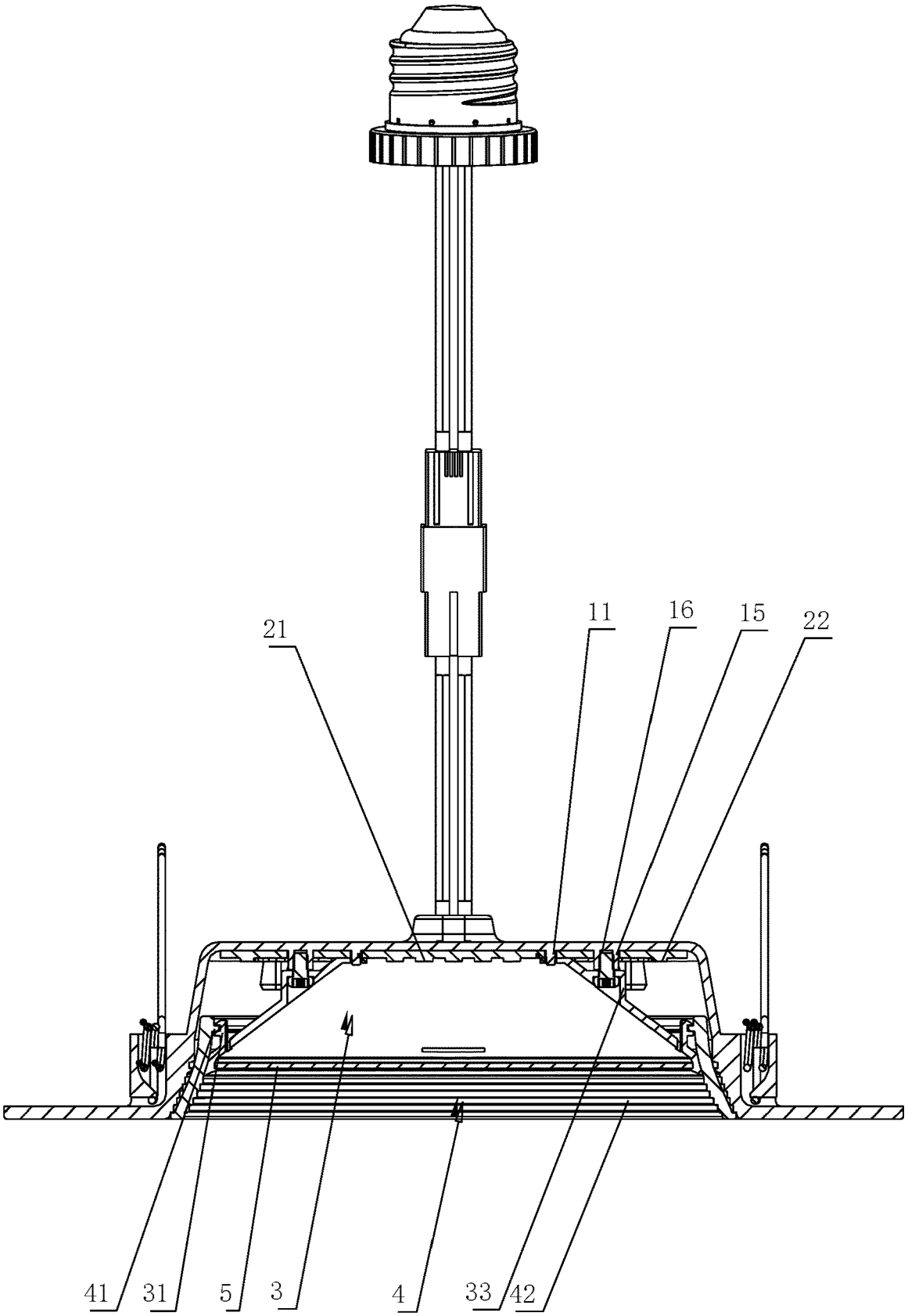
FIG. 3 is a cross-sectional view of a night downlight according to an embodiment of the present application.
Figure 5:
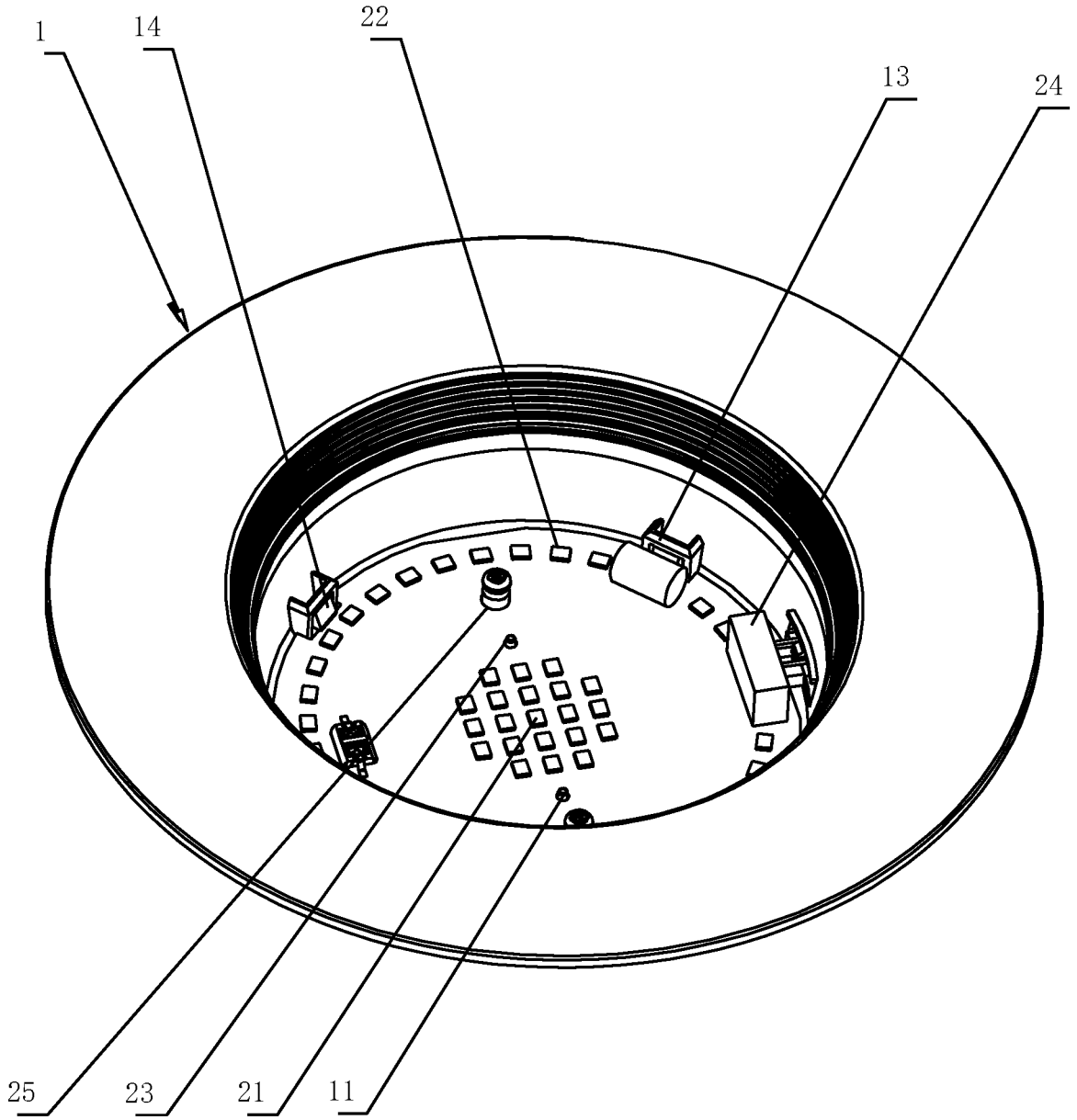
FIG. 5 is a schematic structural diagram illustrating the cooperation between a light source plate and a plastic housing of a night downlight according to an embodiment of the present application.

As shown in FIGS. 2, 3 and 5, the plastic housing 1 is provided with an opening, the light source plate 2 is provided with an inner side of the plastic housing 1 opposite to the opening, and the light source plate 2 is provided with a first light source 21 and a second light source 22, where the first light source 21 serves as a main light source and the second light source 22 serves as a night light source.

Figure 4:
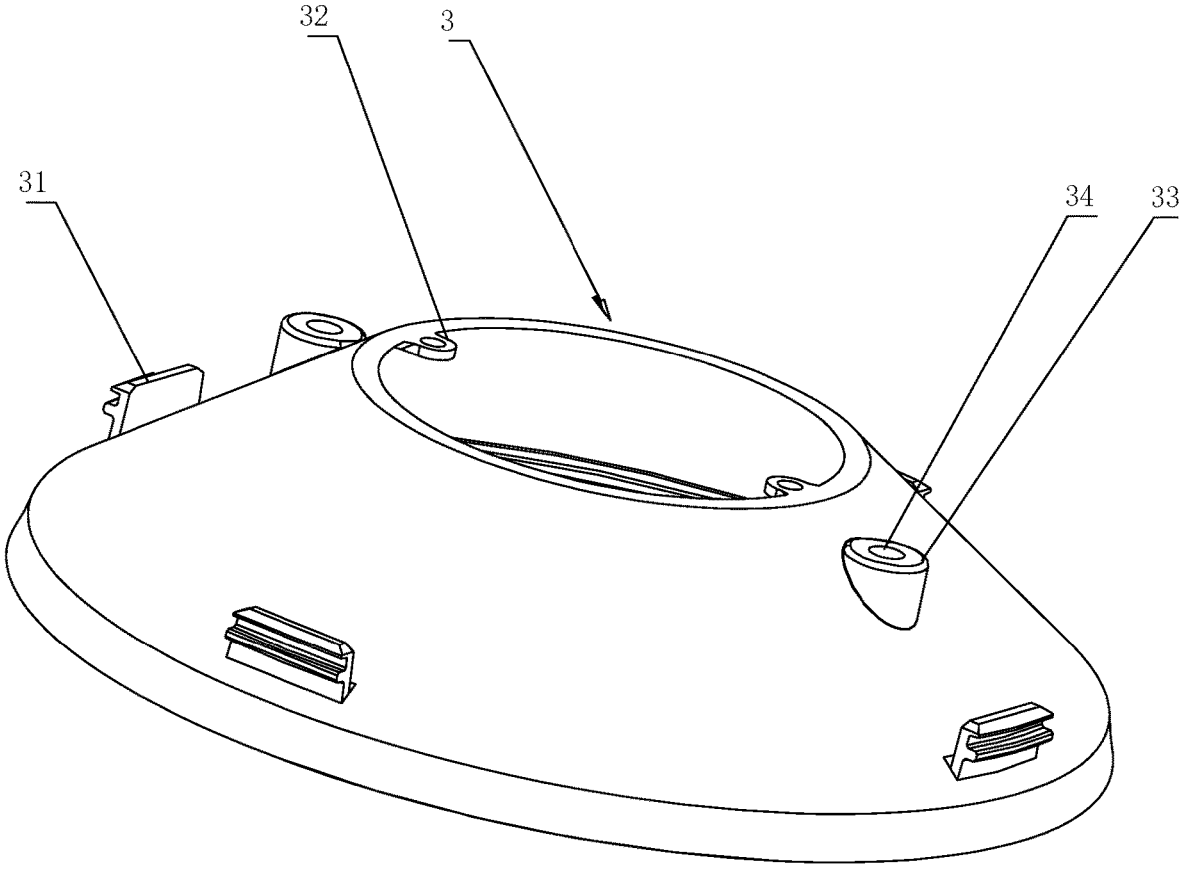
FIG. 4 is a schematic structural diagram of a reflective cup of a night downlight according to an embodiment of the present application.

As shown in FIGS. 2 to 4, the first light source 21 is arranged in the middle of the light source plate 2, and the second light source 22 is arranged around the first light source 21. One end of the reflective cup 3 abuts against the light source plate 2 and separates the first light source 21 and the second light source 22, the light guide sleeve 4 is arranged between the other end of the reflective cup 3 and the plastic housing 1, and the light guide sleeve 4 is in snap-fit with the reflective cup 3. Specifically, the light guide sleeve 4 includes a snap-fit part and an extending part, the snap-fit part is circumferentially provided with a projected snap-fit rib 41 along the light guide sleeve 4, a snap-fit holder 31 protrudes from an outer side of the reflective cup 3, a snap-fit groove is formed in the snap-fit holder 31, and the snap-fit rib 41 is snapped in the snap-fit groove. The extending part is the extension of a lower end of the light guide sleeve 4 to an edge of the opening of the plastic housing 1. In the extending part, the light guide sleeve 4 abuts against the inner wall of the plastic housing 1, and the inner wall of the plastic housing 1 is provided with anti-skid patterns corresponding to the light guide sleeve 4 so as to increase the friction with the light guide sleeve 4 and prevent the light guide sleeve 4 from coming out.

As shown in FIG. 3, an anti-glare ring 42 is arranged on the inner wall of a part, away from the reflective cup 3, of the light guide sleeve 4 to achieve an anti-glare function.

As shown in FIGS. 2 and 3, the end of the reflective cup 3 distal from the light source plate 2 is in snap-fit with a diffuser 5 to expand an illumination range.

As shown in FIGS. 2 and 5, the light source plate 2 is provided with a drive unit 24 arranged between the reflective cup 3 and the inner wall of the plastic housing 1. A slide actuator 12 is arranged on a side face of the plastic housing 1, and the drive unit 24 includes a selector switch connected to the slide actuator 12. The light output of the lamp is adjusted by sliding the slide actuator 12, specifically including three light effects of only the first light source 21 emitting light, only the second light source 22 emitting light, and both the first light source 21 and the second light source 22 emitting light.

As shown in FIGS. 3 to 5, for the mounting and positioning of the plastic housing 1, the light source plate 2 and the reflective cup 3, a positioning column 11 protrudes from the inner side of the plastic housing 1, the light source plate 2 is provided with a first positioning hole 23 corresponding to the positioning column 11, the end, abutting against the light source plate 2, of the reflective cup 3 is provided with a positioning lug 32, and the positioning lug 32 is provided with a second positioning hole corresponding to the positioning column 11. The positioning column 11 of the plastic housing 1 passes through both the first positioning hole 23 of the light source plate 2 and the second positioning hole of the positioning lug 32 of the reflective cup 3, thereby achieving quick positioning.

As shown in FIGS. 2 and 3, then, the fixation of the light source plate 2 and the reflective cup 3 in the plastic housing 1 is accomplished by locking the reflective cup 3 with the plastic housing 1. Specifically, a locking column 15 protrudes from the inner side of the plastic housing 1, a first locking hole 16 is formed on the locking column 15, and an avoiding hole 25 is formed in the light source plate 2 corresponding to the locking column 15. A mounting base 33 protrudes from the inner wall of the reflective cup 3 corresponding to the locking column 15, the mounting base 33 abuts against the locking column 15, and a second locking hole 34 opposite to the first locking hole 16 is formed in the mounting base 33.

As shown in FIG. 5, for the fixation of the light source plate 2 and the plastic housing 1, an abutting base 13 is arranged on the inner wall of the plastic housing 1, an elastic abutting block 14 is arranged on the abutting base 13, the elastic abutting block 14 has an inclined surface at a side opposite to a side face of the light source plate 2, and the length of an end of the elastic abutting block 14 proximal to the opening of the plastic housing 1 is less than the length of an end of the elastic abutting block 14 distal from the opening of the plastic housing 1. The end of the elastic abutting block 14 distal from the opening of the plastic housing 1 abuts against the surface of the light source plate 2. Through the cooperation of the light source plate 2 pressed into the opening of the plastic housing 1 and the elastic abutting block 14, the light source plate 2 is finally placed inside the plastic housing 1 and pressed by the elastic abutting block 14 to prevent the light source plate 2 from coming out of the opening of the plastic housing 1.

The working principle of the application is as follows. In the installation of the whole structure, firstly, the light source plate 2 is pressed into the opening of the plastic housing 1, the edge of the light source plate 2 abuts against the inclined surface of the elastic abutting block 14 and moves towards the inner side of the plastic housing 1 under the guidance of the inclined surface, and the elastic abutting block 14 is elastically deformed to press against the inner wall of the plastic housing 1. Then, when the light source plate 2 is completely placed inside the plastic housing 1, the lower end of the elastic abutting block 14 is flush with the surface of the light source plate 2, and the light source plate 2 no longer presses against the inclined surface, causing the elastic abutting block 14 to rebound so that the lower end of the elastic abutting block 14 abuts against the surface of the light source plate 2, thereby fixing the light source plate 2 so as to prevent it from coming out of the opening of the plastic housing 1.

At the same time as the light source plate 2 is pressed in, the first positioning hole 23 in the light source plate 2 matches with the positioning column 11 on the inner side of the plastic housing 1 to achieve the positioning of the installation of the light source plate 2.

Then, the reflective cup 3 assembled and the light guide sleeve 4 and the diffuser 5 are pressed into the opening of the plastic housing 1. During the press-in process, the positioning lug 32 of the reflective cup 3 is positioned in cooperation with the positioning column 11 of the plastic housing 1, the mounting base 33 of the reflective cup 3 abuts against the locking column 15 of the plastic housing 1 for limitation, and finally, the mounting base 33 is locked with the locking column 15 via a bolt to complete the fixation of the reflective cup 3 and the plastic housing 1.

By sliding the slide actuator 12 on the side face of the plastic housing 1, the drive unit 24 controls the light output of the first light source 21 and the second light source 22 on the light source plate 2, thereby achieving three light effects of only the first light source 21 emitting light, only the second light source 22 emitting light, and both the first light source 21 and the second light source 22 emitting light.

Then, the snap-fit rib 41 of the light guide sleeve 4 is snapped in the snap-fit groove of the snap-fit holder 31 of the reflective cup 3 to fix the light guide sleeve 4 and the reflective cup 3; the diffuser 5 is snapped in the reflective cup 3 to fix the diffuser 5 and the reflective cup 3.

In view of the above, the present application provides a night downlight with a snap-fit design of a light guide sleeve and a reflective cup. Compared with the snap-fit design on the large component, i.e., the face ring, the snap-fit design of the light guide sleeve and the reflective cup allows replacement of the small component, i.e., the reflective cup rather than replacement of the whole face ring when the snap-fit structure fails, thereby effectively reducing waste in repair and replacement. Besides, there is no snap-fit structure on the inner side of plastic housing, so that the mould is simplified, and the cost is reduced. In addition, the first light source emits light via the reflective cup as a main light source, and the second light source emits light via the light guide sleeve 4 as a night light source, so as to enable the downlight to have multiple functions.

The above description is merely an embodiment of the present application, and is not therefore intended to limit the patent scope of the present application, and any equivalent made by using the specification and drawings of the present application, or directly or indirectly applied to the related technical field, is included within the scope of the patent protection of the present application.

What is claimed is:

1. A night downlight, comprising a plastic housing, a light source plate, a reflective cup, and a light guide sleeve, wherein the plastic housing is provided with an opening, the light source plate is arranged on an inner side of the plastic housing opposite to the opening, the light source plate is provided with a first light source and a second light source, the first light source is arranged in the middle of the light source plate, and the second light source is arranged around the first light source; one end of the reflective cup abuts against the light source plate and separates the first light source and the second light source, the light guide sleeve is arranged between the other end of the reflective cup and the plastic housing, and the light guide sleeve is in snap-fit with the reflective cup.

2. The night downlight according to claim 1, wherein a snap-fit holder protrudes from an outer side of the reflective cup, and a snap-fit groove is formed in the snap-fit holder; the light guide sleeve is circumferentially provided with a projected snap-fit rib, and the snap-fit rib is snapped in the snap-fit groove.

3. The night downlight according to claim 1, wherein a lower end of the light guide sleeve extends to an edge of the opening of the plastic housing; the light guide sleeve abuts against an inner wall of the plastic housing, and the inner wall of the plastic housing is provided with anti-skid patterns corresponding to the light guide sleeve.

4. The night downlight according to claim 3, wherein an anti-glare ring is arranged on the inner wall of a part, away from the reflective cup, of the light guide sleeve.

5. The night downlight according to claim 1, wherein a positioning column protrudes from the inner side of the plastic housing, the light source plate is provided with a first positioning hole corresponding to the positioning column, the end, abutting against the light source plate, of the reflective cup is provided with a positioning lug, and the positioning lug is provided with a second positioning hole corresponding to the positioning column.

6. The night downlight according to claim 1, wherein the light source plate is provided with a drive unit arranged between the reflective cup and the inner wall of the plastic housing.

7. The night downlight according to claim 6, wherein a slide actuator is arranged on a side face of the plastic housing, and the drive unit comprises a selector switch connected to the slide actuator.

8. The night downlight according to claim 1, wherein an abutting base is arranged on the inner wall of the plastic housing, an elastic abutting block is arranged on the abutting base, the elastic abutting block has an inclined surface at a side opposite to a side face of the light source plate, and the length of an end of the elastic abutting block proximal to the opening of the plastic housing is less than the length of an end of the elastic abutting block distal from the opening of the plastic housing; the end of the elastic abutting block distal from the opening of the plastic housing abuts against the surface of the light source plate.

9. The night downlight according to claim 1, further comprising a diffuser, wherein the end of the reflective cup away from the light source plate is in snap-fit with the diffuser.

10. The night downlight according to claim 1, wherein a locking column protrudes from the inner side of the plastic housing, a first locking hole is formed in the locking column, and an avoiding hole is formed in the light source plate corresponding to the locking column; a mounting base protrudes from the inner wall of the reflective cup corresponding to the locking column, the mounting base abuts against the locking column, and a second locking hole opposite to the first lock hole is formed in the mounting base.

* * * * *